United States Patent [19]

Shuck

[11] 4,095,650

[45] Jun. 20, 1978

[54] METHOD FOR INCREASING THE CALORIFIC VALUE OF GAS PRODUCED BY THE IN SITU COMBUSTION OF COAL

[75] Inventor: Lowell Z. Shuck, Morgantown, W. Va.

[73] Assignee: The United States of America as represented by the United States Department of Energy, Washington, D.C.

[21] Appl. No.: 823,480

[22] Filed: Aug. 10, 1977

[51] Int. Cl.[2] ..... E21B 43/24

[52] U.S. Cl. ..... 166/256; 48/DIG. 6; 166/50; 166/52

[58] Field of Search ..... 166/256, 259, 251, 245, 166/50, 52; 48/210, 197 R, DIG. 6

[56] References Cited

U.S. PATENT DOCUMENTS

| | | | |
|---|---|---|---|
| 2,788,956 | 4/1957 | Pevere et al. | 166/259 |
| 3,563,606 | 2/1971 | Sears | 166/259 X |
| 3,770,398 | 11/1973 | Abraham et al. | 166/256 X |
| 3,775,073 | 11/1973 | Rhoades | 166/259 X |
| 3,865,186 | 2/1975 | Von Hippel | 166/256 |
| 3,933,447 | 1/1976 | Pasini et al. | 166/259 X |
| 3,997,005 | 12/1976 | Komar | 166/251 |
| 4,015,663 | 4/1977 | Strubhar | 166/259 X |
| 4,024,914 | 5/1977 | Kreinin | 166/256 X |
| 4,062,404 | 12/1977 | Pasini et al. | 166/259 |

*Primary Examiner*—Stephen J. Novosad
*Attorney, Agent, or Firm*—Dean E. Carlson; David S. Zachry; Earl L. Larcher

[57] ABSTRACT

The present invention relates to the production of relatively high Btu gas by the in situ combustion of subterranean coal. The coal bed is penetrated with a horizontally-extending borehole and combustion is initiated in the coal bed contiguous to the borehole. The absolute pressure within the resulting combustion zone is then regulated at a desired value near the pore pressure within the coal bed so that selected quantities of water naturally present in the coal will flow into the combustion zone to effect a hydrogen and carbon monoxide-producing steam-carbon reaction with the hot carbon in the combustion zone for increasing the calorific value of the product gas.

4 Claims, 2 Drawing Figures

Figure 1:
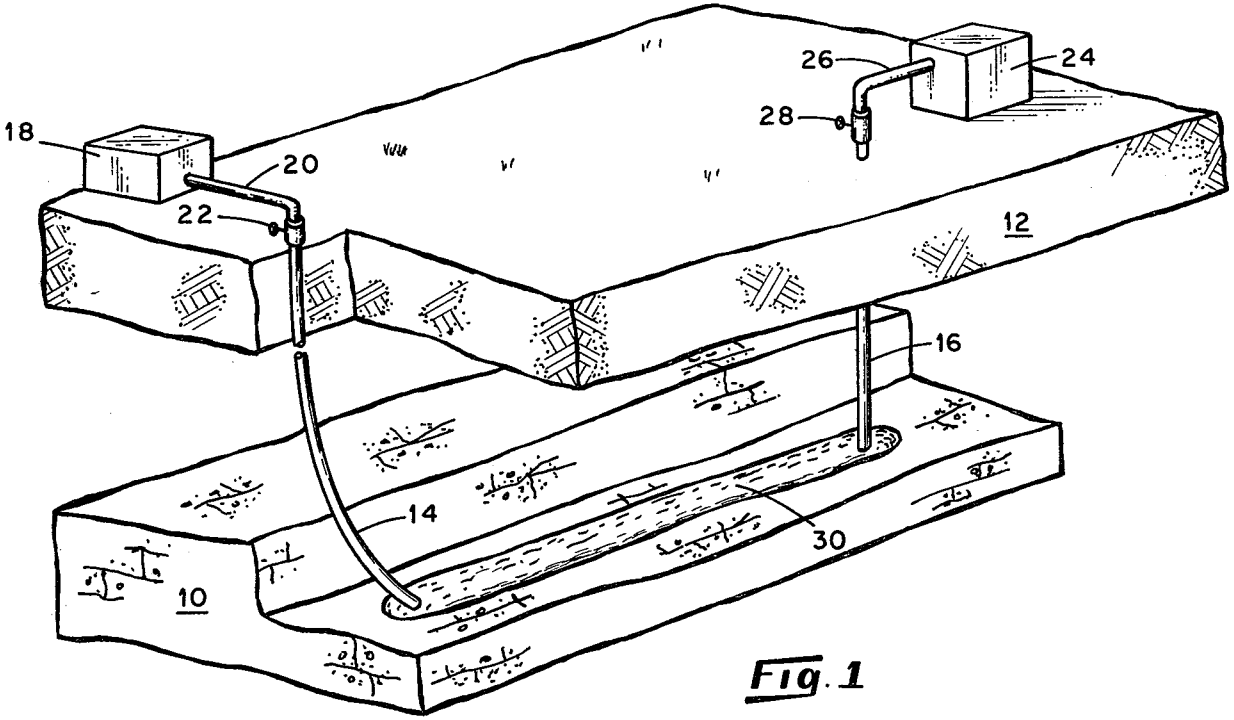

METHOD FOR INCREASING THE CALORIFIC VALUE OF GAS PRODUCED BY THE IN SITU COMBUSTION OF COAL

The present invention relates generally to the in situ combustion of subterranean coal for the production of combustible gas, and more particularly to a method for increasing the Btu content of the combustible gas.

The utilization of carbon-containing gases derived from the in situ gasification of subterranean coal formations is becoming of increasing importance in meeting the energy requirements of the world. Such in situ gasification processes are usually initiated in the coal bed with the resulting combustion zone expanding through the coal formation in either a reverse or forward burn configuration. The heat of combustion gasifies the coal to provide recoverable gaseous products which contain considerable energy values.

Several variables are associated with the in situ combustion process which determines operating parameters. For example, in a conventional in situ combustion process the coal bed is penetrated by a borehole or a plurality of boreholes with the separation of the boreholes being determined by such factors as the allowable air used for supporting combustion, the air velocity in the coal bed, the permeability of the coal bed and the particular type of coal. In the recovery of such carbon-containing gases by the gasification thereof, the gaseous product of a forward burn process flows through a portion of the coal bed to a production well where the gaseous products are withdrawn. The control of the combustion zone with respect to this burn configuration and the rate of propagation thereof in the subterranean coal bed presents some problems in that the operating parameters must be carefully controlled so as to maintain the Btu content of the gases at an acceptable or desirable level. Normally forward burn gasification is limited to non-coking coals, such as lignite and subbituminous coal, since coals with relatively higher coking values present considerable impediments to the combustion-supporting medium in reaching the burn front and also release excessive tar vapors which are carried with the gaseous products into the cooler regions of the coal bed where the vapors condense so as to further reduce the permeability of the coal bed.

Several efforts have been previously made for enhancing the recovery of energy values from subterranean coal beds by in situ combustion. One such effort is disclosed in assignee's U.S. Pat. No. 3,933,447, which issued Jan. 20, 1976, entitled "Underground Gasification of Coal" by Joseph Pasini III et al. In this patent, gasification of the underground coal bed is achieved by penetrating the coal bed with spaced-apart directionally drilled boreholes which project along a horizontal plane within the coal bed and extend in a direction normal to the plane of maximum permeability. The combustion of coal is initiated in one of the horizontal boreholes with the gaseous products being recovered from the other borehole which is spaced from the combustion zone along the plane of maximum permeability. The combustion process in assignee's patent is enhanced by utilizing the natural fracture system extending between the combustion zone in registry with the injection borehole and the producer borehole so as to ensure the production and recoverability of the product gases as well as the propagation of the combustion zone therebetween. It is further contemplated in assignee's patent to induce fractures in the coal bed extending between the boreholes so as to further enhance the removal of the product gas.

While the use of directionally-drilled boreholes, as described in assignee's aforementioned patent, provides an improvement in coal gasification, there are still some shortcomings which detract from known coal gasification processes. Of primary concern in coal gasification is the production of a gas with a sufficiently high Btu content to support combustion. Normally, a calorific value of about 80 Btu/SCF is required for supporting combustion in an efficient manner. The product gases resulting from a typical gasification operation are normally composed of hydrocarbons, e.g., methane, as well as carbon dioxide and carbon monoxide. The carbon dioxide in the mixture does not contribute to the heating value of the product gas but normally comprises about 12 to 18 percent of the product. The carbon and oxygen of the combustion-supporting medium apparently preferentially react to form carbon dioxide rather than carbon monoxide in the combustion zone while the carbon monoxide in the product results from the combined effects of the steam carbon reaction ($C + H_2O \rightarrow CO + H_2$) and the water-gas shift reaction ($CO_2 + H_2 \rightarrow H_2O + CO$). However, the utilization of the natural water in the coal bed for increasing the concentration of CO and $H_2$ in the product gas by the aforementioned reactions has not been efficiently exploited. In previous in situ combustion processes the operating pressures in the combustion zones were maintained considerably higher than the pore pressure in the coal beds so that a substantial quantity of the available water in the coal was effectively or significantly reduced a valuable and available source of a reactant suitable for increasing the Btu yield of the product gas. Also, excess water in the combustion zone presented combustion control problems, especially where there was some difficulty in maintaining the combustion of the coal, especially in the higher coking coals where the coke formation in the combustion zone presented considerable impedance to air flow for maintaining the combustion process in the coal bed. Further, by having excess water in the combustion zone a considerable quantity of steam is generated in the combustion zone and appears in the product gas which detracts from the optimization of the product gas composition. If maximum heating value is desired the presence of excess steam represents a loss of thermal energy which could otherwise be used in propagating the gasification process. The amount of water vapor distributed in the coal may also control the amount of thermal fracturing that occurs adjacent to the combustion front thereby enhancing rate of gasification possible.

Accordingly, it is the primary objective or aim of the present invention to efficiently utilize the available water in the subterranean coal bed in an in situ combustion operation for increasing the CO and $H_2$ concentration in the product gas to increase the Btu content of the latter about 25 to 100 Btu/SCF, improving the overall process thermal recovery efficiency by as much as 15 to 20 percent, and reducing the amount of impure water that must be treated at the surface. These goals are achieved by establishing a combustion zone in a subterranean coal bed and thereafter regulating the absolute pressure in the combustion zone at a pressure near the pore pressure of the coal bed by controlling the air input and the discharge of the gaseous product from the combustion zone. By maintaining or cycling the absolute pressure in the combustion zone near or even below the pore pressure provides for selected quantities of the naturally present water in the coal bed to seep into the combustion zone and react with the hot carbon at the burn front in the steam-carbon reaction which produces CO and $H_2$. This quantity of water introduced into the combustion zone can be carefully regulated so as not to extinguish or excessively retard the combustion of the coal or cause considerable quantities of water to be unreacted and converted into steam which may drop the temperature in the combustion zone to a level below that at which efficient gasification occurs. The regulation of the pressure in the combustion zone to achieve the desirable Btu yield of the product gas may be easily accomplished by analyzing the gas composition of the gases discharged from the combustion zone.

Other and further objects of the invention will be obvious upon an understanding of the illustrative method about to be described, or will be indicated in the appended claims, and various advantages not referred to herein will occur to one skilled in the art upon employment of the invention in practice.

Preferred embodiments of the invention have been chosen for the purpose of facilitating the illustration and description of the disclosed method. The preferred embodiments illustrated are not intended to be exhaustive or to limit the method of the invention to the precise forms disclosed. They are chosen and described in order to best explain the principles of the invention and their application in practical use to thereby enable others skilled in the art to best utilize the invention in various embodiments and modifications of the method steps as are best adapted to the particular use contemplated.

Figure 2:
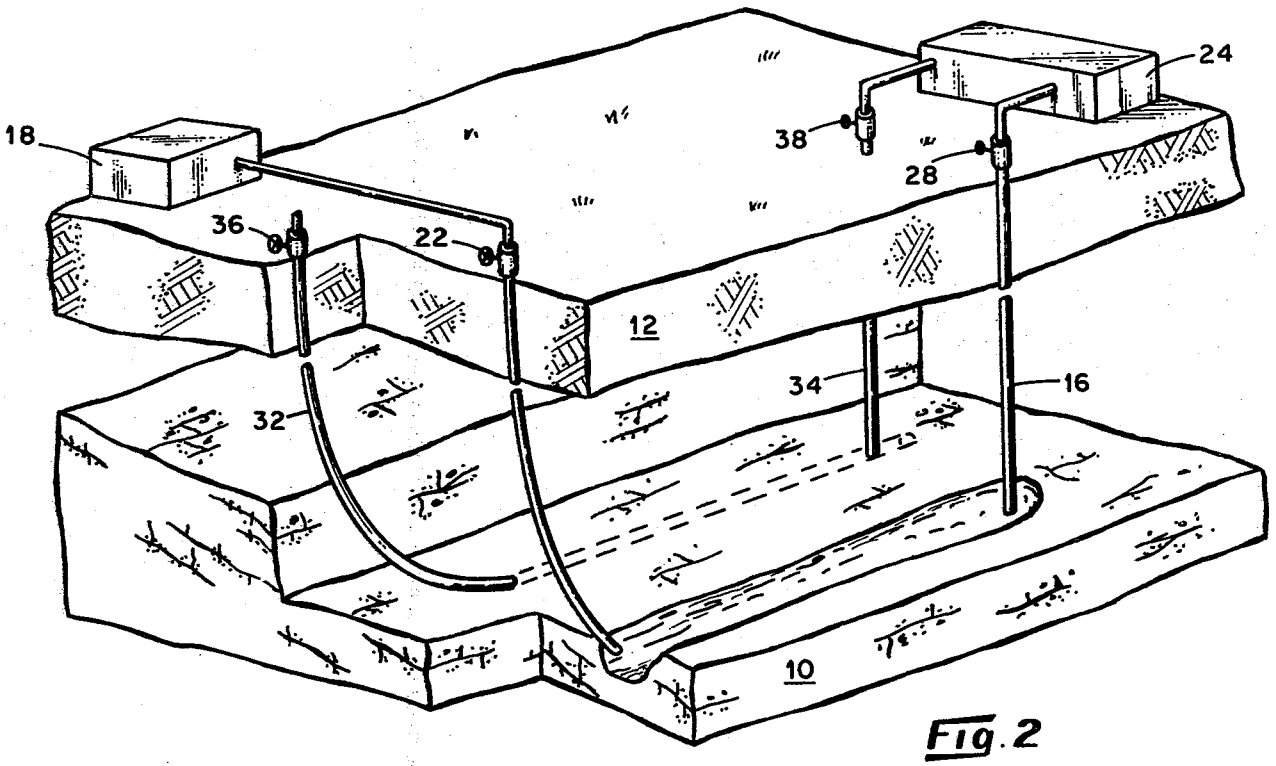

In the accompanying drawings:

FIG. 1 is a highly schematic perspective view showing an earth formation containing a subterranean coal bed which has been provided with a borehole and valving arrangement suitable for practicing the method of the present invention; and FIG. 2 is a similar schematic view of the earth formation in which a sloping coal bed has been penetrated with a plurality of boreholes for practicing a variation of the present invention.

Described generally, the present invention is directed to a method for increasing the concentration of carbon monoxide and hydrogen in the product gases resulting from the in situ combustion of coal in a subterranean coal formation. The total concentration of carbon monoxide and hydrogen in the product gas as produced by practicing previously known in situ gasification techniques is in the range of about 5 to 15 percent. By practicing the method of the present invention the concentration of carbon monoxide and hydrogen in the product gas can be increased to about 30 to 50 percent. This increase in the concentration of the carbon monoxide and hydrogen by practicing the method described herein increases the heating value of the product gas by about 25 to 100 Btu/SCF up to a total heating value of about 175 Btu/SCF.

The method of the present invention may be practiced by establishing a combustion zone within a borehole penetrating a subterranean coal bed by initiating an exothermic combustion reaction within the coal bed in any desired conventional manner and thereafter supporting the exothermic reaction by conveying a combustion-supporting medium (air) into the resulting combustion zone while discharging product gases from the combustion zone. After the exothermic reaction has been established, the rate of flow of combustion-supporting medium and the rate of discharge of the product gases are selectively regulated at a value slightly above or below the pore pressure in the coal bed. By controlling the absolute pressure in the combustion zone by such regulation of the injection rate of the air and the backpressure in the combustion zone, the pressure in the combustion zone can be maintained or selectively varied at any level above or below the pore pressure in the coal bed. The difference in pressure between that in the combustion zone and that in the coal bed determines whether water will seep into the combustion zone or be driven back into the coal bed. Thus, by properly adjusting the absolute pressure in the combustion zone, the desired quantity of water can be admitted to the combustion zone to give a good quality gas through the steam-carbon reaction wherein $H_2O + C \rightarrow CO + H_2$. The quality of the gas can be readily evaluated by sampling the gaseous products at the wellbore discharge. The necessary backpressure for establishing the absolute pressure within the wellbore necessarily increases as the pressure and depth increases since the pressure will vary from a low value of about 0.43 psi per foot of depth to perhaps as much as 1 psi per foot of depth at a greater depth. Normally, an absolute pressure in the combustion zone in the range of about 50 psi less than to 50 psi more than the bore pressure is satisfactory for practicing the present invention under typical coal bed permeabilities of 0.1 to 100 millidarcys.

Described more specifically and with reference to FIG. 1 of the accompanying drawings, the subterranean coal bed 10 is disposed below one or more layers of overburden 12. A directional borehole 14 is drilled through the surface of the overburden 12 at a slant or angle so as to penetrate the subterranean coal bed 10 along a substantially horizontally oriented path with respect to the coal bed 10. The borehole 14 may be drilled either continuously from the surface of the overburden 12 through a selected portion of the coal bed and back to the surface of the overburden 12, or, alternatively, from the surface of the overburden 12 into the coal bed 10 and terminate at some selected location therein. The drilling of the borehole 14 within the coal bed may be initiated at any desired vertical angle from the surface of the overburden 12 with this angle depending upon the depth of he coal bed and the drilling equipment employed. The drilling procedure should be such that when the borehole 14 enters the coal bed 10, it extends essentially in a horizontal direction so as to penetrate the desired portion of the coal bed 10. The use of such a horizontal borehole substantially minimizes the number of boreholes necessary to contact a relatively large segment of the coal bed but, if desired, a plurality of conventional vertical boreholes may also be used to practice the method of the present invention.

The borehole 14 extends horizontally within the coal bed along a plane oriented substantially perpendicular to the plane of maximum permeability of the coal bed so that the desired water flow may be more readily achieved in the coal bed for enhancing the calorific value of the product gas. In a preferred practice of the invention a vertically extending borehole 16 is provided at the terminal end of the horizontal borehole 14 so as to intercept the horizontal borehole. Further details relating to the drilling of the horizontal borehole is set forth in assignee's aformentioned patent.

The borehole 14 is coupled to an air source 18 via a conduit 20. A valve 22 is provided on the conduit 20 for selectively regulating the quatity of air admitted into the coal bed through the borehole. The vertical borehole 16 is, in turn, coupled to a suitable combustion product analyzer 24 via conduit 26. This conduit 26 is provided with a valve 28 for selectively controlling the backpressure within the combustion zone to be established within the coal bed in proximity to the horizontal borehole 14. The combustion product analyzer 24 must be of a type which can analyze a sample and indicate the composition in less than 5 minutes in order to use the output data for process control. Various commercially available mass spectrometers are suitable for such on-line applications.

Upon completion of the drilling steps the combustion of the coal 10 may be initiated in any suitable well-known manner so as to provide a combustion zone 30 extending over the entire length of the borehole 14. The combustion-supporting medium, i.e., air, is injected into the coal bed from the air source 18 to effect the exothermic combustion of the coal at a temperature of about 2000° F. for forming a product gas which is exhausted or extracted from the combustion zone via the vertical borehole 16.

After the combustion zone 30 is established in the coal bed, the product gas exhausted from the combustion zone is analyzed in the analyzer 24 for determining the CO and $H_2$ concentrations. The inlet or injection rate of the air and the backpressure in the combustion zone are then gradually decreased until the concentration of the CO and $H_2$ in the product gas increases about 30 to 50 percent which is indicative of the water entering the combustion zone and reacting with the hot carbon in the combustion zone in the steam-water reaction ($H_2O + C \rightarrow CO + H_2$). With this absolute pressure in the combustion zone 30 being at a value above or below the pore pressure in the coal bed as set forth above, the difference in pressure in the combustion zone and the pore pressure of the coal bed determines the quantity of water which will flow into the combustion zone. Thus, by properly maintaining the quantity of water entering the combustion zone at selected constant or cycled flow rates, the CO and $H_2$ concentration of the product gas may be maintained at a level considerably higher than would be available without allowing the water to enter the combustion zone at the controlled rate. While this combustion process which functions at relatively low pressure and flow rates provides for a relatively slow burn which may be only at the rate of about 1 to 2 inches every 3 days, the Btu value of the product gas is considerably higher than available without the steam-carbon reaction. By continually sampling the gaseous products in the analyzer 24, the proper air injection rate and backpressure can be easily controlled by regulating valves 22 and 28 so as to maintain the desired pressure difference in the combustion zone 30 to provide the desired CO and $H_2$ concentration in the product gas.

The embodiment shown in FIG. 2 is particularly useful for coal beds disposed on an incline with respect to the horizontal plane. In this embodiment a wellbore 32 is drilled into the coal bed preferably in a manner similar to borehole 14 but which lies in a horizontal plane higher than that of borehole 14 and spaced therefrom along the plane of maximum permeability through the coal bed. A vertical wellbore 34 is also placed in registry with the terminal end of the bore 32. As with the FIG. 1 embodiment, the boreholes 32 and 34 are provided with valves 36 and 38 for controlling the fluid injection and removal of the gaseous product from the coal bed. The borehole 34 is coupled to the gaseous product analyzer 24. As shown in FIG. 2, the coal bed 10 is laying on an incline with respect to the horizontal overburden 12 so that the combustion zone 30 contiguous to borehole 14 will be disposed at a lower level or plane than the borehole 32.

In operation of the FIG. 2 embodiment the ignition of the coal is initiated to establish combustion zone 30 in the same manner as the FIG. 1 embodiment. After establishing the combustion zone 30, valves 28 and 36 are closed. The air injected into the combustion zone 30 and the discharge of the gaseous product from the combustion are controlled by valves 22 and 38, respectively. This mode of operation is a forward burn with the products of combustion percolating through the coal bed 10 from the combustion zone 30 into borehole 32 for discharge through the vertical borehole 34. The primary advantage of this type of operation is that the absolute pressure within the combustion zone 30 may be maintained at a higher value than the pore pressure in the coal bed and still have the desired quantity of water enter the combustion zone 30 for providing the desired steam-carbon reaction as heretofore described since gravity will aid in forcing the water into the combustion zone as the burn front advances toward boreholes 32 and 34. When the combustion zone reaches the borehole 32 the combustion operation is terminated and a similar longitudinal borehole may then be placed at a location further up the inclined coal bed and the process repeated with the combustion-supporting medium being supplied via the borehole 32.

It will be seen that the present invention provides an improvement in the coal gasification art in that the water naturally present in the coal bed can be fully utilized to provide product gas with increased Btu content.

What is claimed is:

1. A method for the production of combustible gas by the in situ gasification of coal in subterranean coal bed, comprising the steps of penetrating the coal bed with at least one borehole, initiating combustion of the coal disposed contiguous to the borehole, and selectively varying the absolute pressure with the resulting combustion zone at a level which will provide sufficient leakage of natural water in the coal bed into the combustion zone for providing a CO and $H_2$ producing reaction between the water and hot carbon in the combustion zone to increase the Btu content of the combustible gas from about 25 to 100 Btu/SCF.

2. The method claimed in claim 1, wherein the absolute pressure within the combustion zone is selectively controlled in the range of 50 psi less than to 50 psi greater than the pore pressure in the coal bed.

3. The method claimed in claim 2, wherein said at least one borehole comprises a first borehole projecting in a relatively horizontal direction within the coal bed along a plane disposed orthogonally to the plane of maximum permeability in the coal bed and a second borehole in registry with the first borehole, wherein the combustion zone is contiguous to the first borehole, wherein the combustion-supporting medium is introduced into the combustion zone through said first borehole and the combustible gas is removed from the combustion zone through the second borehole, and wherein the step of selectively varying the absolute pressure within the combustion zone is provided by controlling the flow of combustion-supporting medium into the combustion zone and regulating the backpressure in the combustion zone by controlling the discharge of the combustible gas from the combustion zone through said second borehole.

4. A method claimed in claim 2, wherein said at least one borehole comprises first and second boreholes penetrating said coal bed at spaced-apart locations and projecting along parallel paths in a relatively horizontal direction within said coal bed and along a plane disposed orthogonal to the plane of maximum permeability in the coal bed, with said plane of maximum permeability being disposed at an angle with respect to a horizontal orientation, wherein said second borehole is disposed along a path lying in a plane above said first borehole, wherein a further borehole is in registry with said second borehole, wherein the combustion zone is contiguous to the first borehole, wherein the combustion-supporting medium is introduced into the combustion zone through said first borehole and the combustion gas is removed from the combustion zone through said further borehole, and wherein the step of selectively varying the absolute pressure within the combustion zone is provided by controlling the flow of combustion-supporting medium into the combustion zone and regulating the backpressure in the combustion zone by controlling the discharge of the combustible gas from the combustion zone through said further borehole.

* * * * *